US009740162B2

(12) United States Patent
Osaki et al.

(10) Patent No.: US 9,740,162 B2
(45) Date of Patent: Aug. 22, 2017

(54) IMAGE FORMING APPARATUS

(71) Applicant: KYOCERA Document Solutions Inc., Osaka (JP)

(72) Inventors: Shuji Osaki, Osaka (JP); Tsuyoshi Koyanagi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/080,774

(22) Filed: Mar. 25, 2016

(65) Prior Publication Data

US 2016/0282803 A1 Sep. 29, 2016

(30) Foreign Application Priority Data

Mar. 27, 2015 (JP) ..... 2015-065823
Feb. 2, 2016 (JP) ..... 2016-018443

(51) Int. Cl.

| | |
|---|---|
| ***G03G 15/00*** | (2006.01) |
| ***G03G 21/16*** | (2006.01) |
| ***B65H 29/12*** | (2006.01) |
| ***B65H 31/02*** | (2006.01) |
| ***B65H 31/22*** | (2006.01) |

(52) U.S. Cl.

CPC ..... *G03G 21/1647* (2013.01); *B65H 29/125* (2013.01); *B65H 31/02* (2013.01); *B65H 31/22* (2013.01); *B65H 2301/4212* (2013.01); *B65H 2402/10* (2013.01); *B65H 2402/62* (2013.01); *B65H 2405/332* (2013.01); *B65H 2408/11* (2013.01); *B65H 2557/10* (2013.01); *B65H 2801/27* (2013.01); *G03G 2221/1696* (2013.01)

(58) Field of Classification Search

CPC ..... G03G 21/1647
USPC ..... 399/407
See application file for complete search history.

(56) References Cited

U.S. PATENT DOCUMENTS 4,917,364 A * 4/1990 Iida ..... B42C 1/12 227/99
5,283,612 A * 2/1994 Lodermann ..... G03G 15/65 399/107
6,311,032 B1 * 10/2001 Carter, Jr. ..... B65H 31/22 270/58.01
6,898,394 B2 * 5/2005 Schuller ..... G03G 15/6552 399/107
7,136,606 B2 * 11/2006 Rose ..... G03G 21/1647 399/107
7,277,660 B2 * 10/2007 Umeyama ..... G03G 21/1619 399/107
7,287,998 B2 * 10/2007 Masai ..... G03G 21/1652 439/342

(Continued)

FOREIGN PATENT DOCUMENTS

JP 2011-137900 7/2011

*Primary Examiner* — Anthony Nguyen
(74) *Attorney, Agent, or Firm* — Wenderoth, Lind & Ponack, L.L.P.

(57) ABSTRACT

A relay conveyance device detachably mounted on an image forming apparatus body is provided with a fixing member that holds a mounting state of the relay conveyance device to the image forming apparatus body. The fixing member is provided with a relay connector that relays the image forming apparatus body and the post-processing device. The post-processing device is electrically connected to the image forming apparatus body via the relay connector.

5 Claims, 13 Drawing Sheets

(56) References Cited

U.S. PATENT DOCUMENTS

| | | | | |
|---|---|---|---|---|
| 7,821,681 | B2 * | 10/2010 | Matsumoto | H04N 1/00519 358/401 |
| 2004/0208669 | A1 * | 10/2004 | Tokishige | G03G 21/1652 399/107 |
| 2009/0072472 | A1 * | 3/2009 | Yasui | G03G 15/234 271/225 |
| 2010/0178093 | A1 * | 7/2010 | Niizuma | G03G 15/6552 399/407 |
| 2012/0134728 | A1 * | 5/2012 | Kotera | G03G 15/5004 399/407 |

* cited by examiner

IMAGE FORMING APPARATUS

CROSS-REFERENCE TO RELATED APPLICATION

This application is based upon and claims the benefit of priority from Japanese Patent Application No. 2015-065823 filed on Mar. 27, 2015 and Japanese Patent Application No. 2016-18443 filed on Feb. 2, 2016, the entire contents of which are incorporated herein by reference.

BACKGROUND

The technology of the present disclosure relates to an image forming apparatus including a relay conveyance device that conveys papers, which was subjected to image formation and discharged to a paper discharge unit of an image forming apparatus body, to a post-processing device provided to the image forming apparatus body.

In an image forming apparatus such as a copy machine and a printer, there has been proposed an apparatus of a type provided with a post-processing device capable of performing a process of collectively stitching paper bundles subjected to image formation with a staple, and the like. This type of image forming apparatus includes a relay conveyance device conveys the papers subjected to image formation to the post-processing device.

SUMMARY

An image forming apparatus according to one aspect of the present disclosure includes an image forming apparatus body and a relay conveyance device. The relay conveyance device is detachably mounted on the image forming apparatus body. Furthermore, the relay conveyance device conveys a paper, which was subjected to image formation and discharged to a paper discharge unit of the image forming apparatus body, to a post-processing device provided to the image forming apparatus body. The aforementioned relay conveyance device is provided with a fixing member that holds a mounting state of the relay conveyance device to the aforementioned image forming apparatus body. The fixing member is provided with a relay connector that relays the aforementioned image forming apparatus body and the aforementioned post-processing device. The aforementioned post-processing device is electrically connected to the aforementioned image forming apparatus body via the aforementioned relay connector.

DETAILED DESCRIPTION

Figure 1:
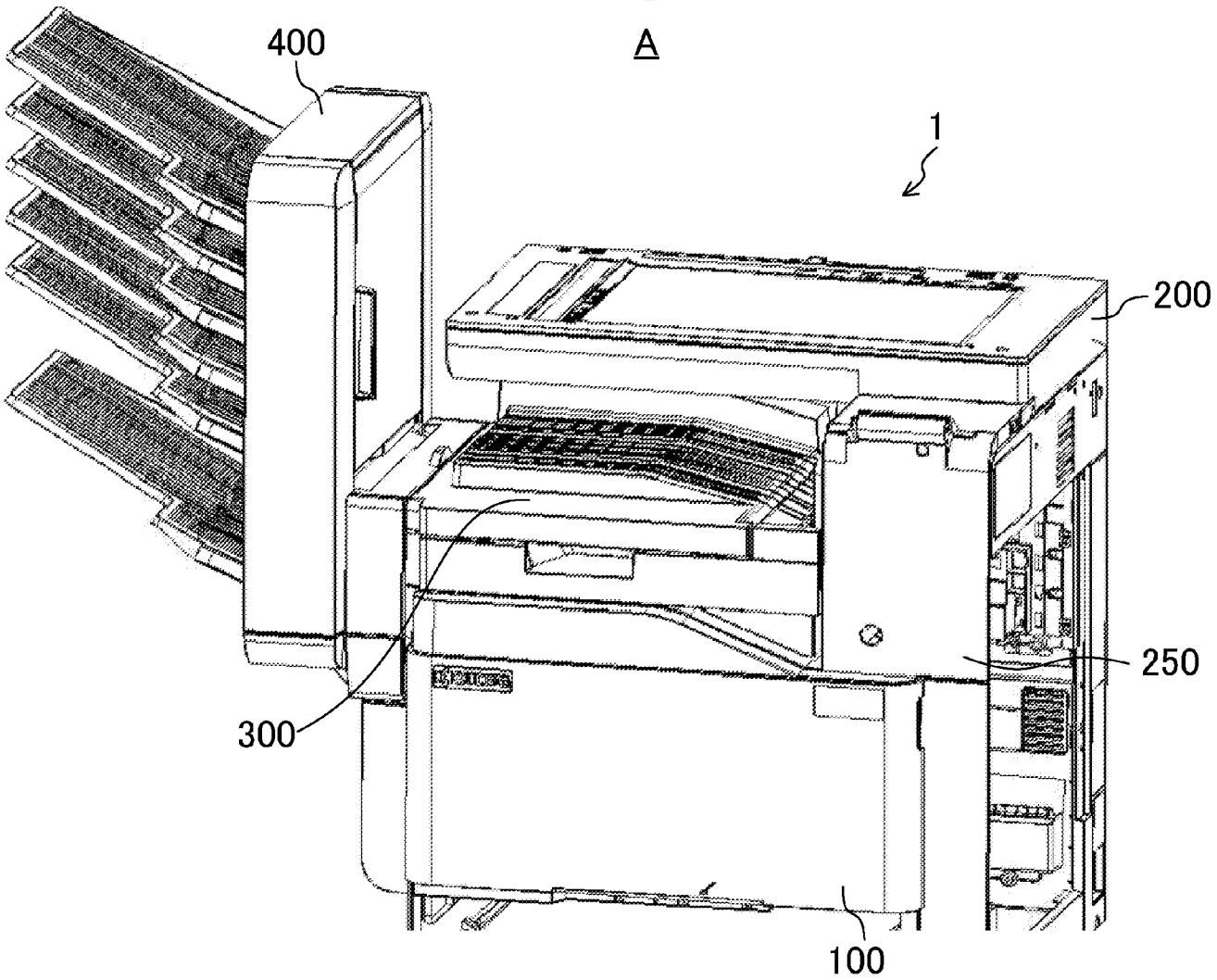
FIG. 1 is a diagram illustrating an external appearance of an image forming apparatus provided with a post-processing device.
Figure 2:
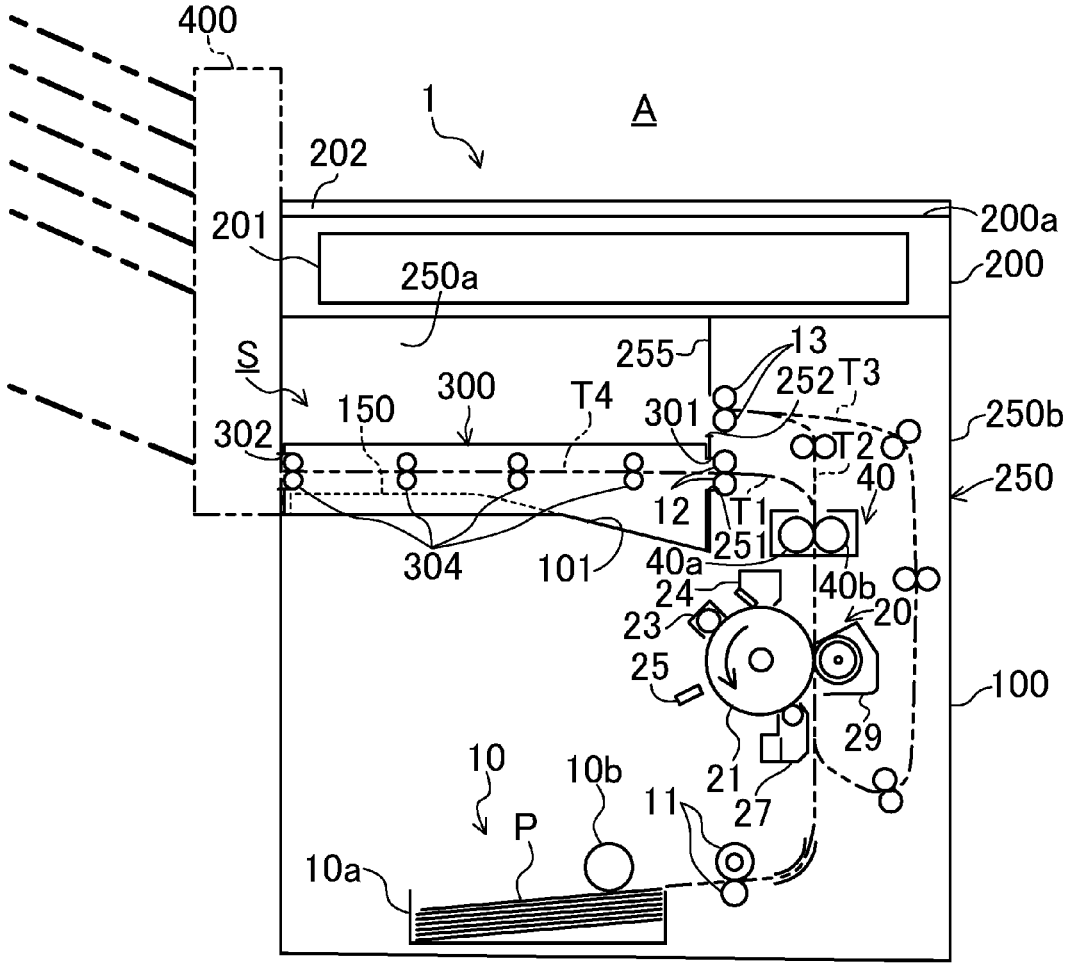
FIG. 2 is a schematic diagram illustrating an internal structure of an image forming apparatus body.
Figure 3:
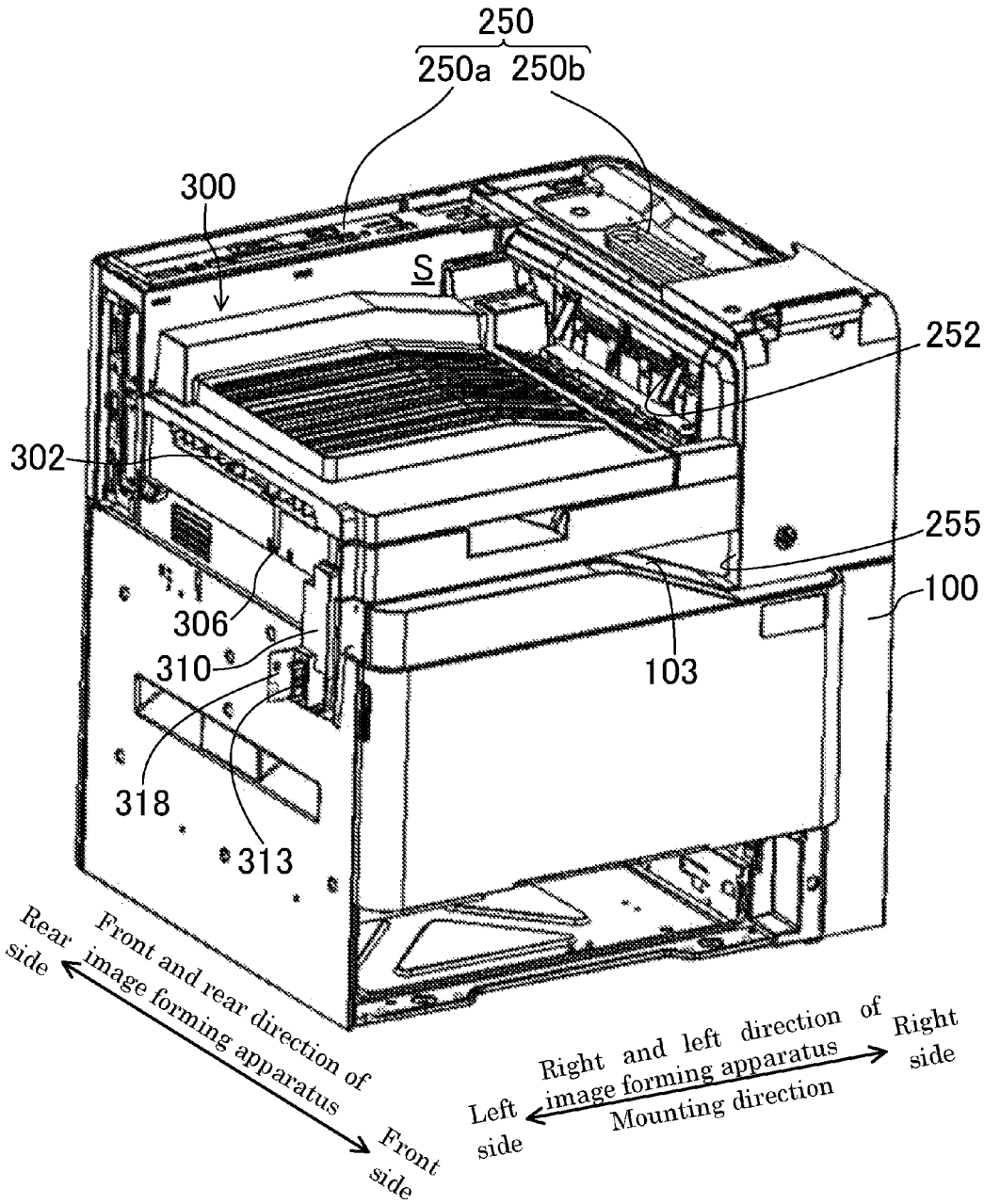
FIG. 3 is a perspective view illustrating a state in which a relay conveyance device has been mounted on an image forming apparatus body.

Hereinafter, an example of an embodiment will be described in detail on the basis of the drawings. It is noted that the technology of the present disclosure is not limited to the following embodiments.

FIG. 1 to FIG. 5 illustrate a digital copy machine which is an example of an image forming apparatus A in the present embodiment. In the following description, unless otherwise specifically mentioned, a "front side" and a "rear side" indicate a front side and a rear side of the image forming apparatus A, and a "left side" and a "right side" indicate a left side and a right side when the image forming apparatus A is viewed from the front side.

The image forming apparatus A is a so-called in-body paper discharge type copy machine and a relay conveyance device 300 is detachably mounted on an image forming apparatus body 1. Furthermore, the image forming apparatus A (the image forming apparatus body 1) is provided at a left side thereof with a post-processing device 400, and the post-processing device 400 is connected to the image forming apparatus body 1 via the relay conveyance device 300.

The image forming apparatus body 1 has a body casing part 100, a scanner casing part 200, and a connection casing part 250. In the scanner casing part 200, an image reading unit 201 for reading a document image is accommodated, and in the body casing part 100, an image forming unit 20 and a fixing unit 40 for printing the document image read by the image reading unit 201 on a paper P are accommodated. The scanner casing part 200 is arranged above the body casing part 100. The body casing part 100 and the scanner casing part 200 are connected to each other via the connection casing part 250.

The connection casing part 250 has a rear connection casing part 250*a* extending upward from a rear end portion of an upper part of the body casing part 100 and a right connection casing part 250*b* extending upward from a right end portion of the upper part of the body casing part 100. Between the body casing part 100 and the scanner casing part 200, an in-body paper discharge space (a paper discharge unit) S is formed. In the right connection casing part 250*b*, a vertical wall part 255 facing the in-body paper discharge space S is formed with a first paper discharge port 251 and a second paper discharge port 252 vertically formed in a row. In the in-body paper discharge space S, the relay conveyance device 300 is configured to be detachable.

Figure 4:
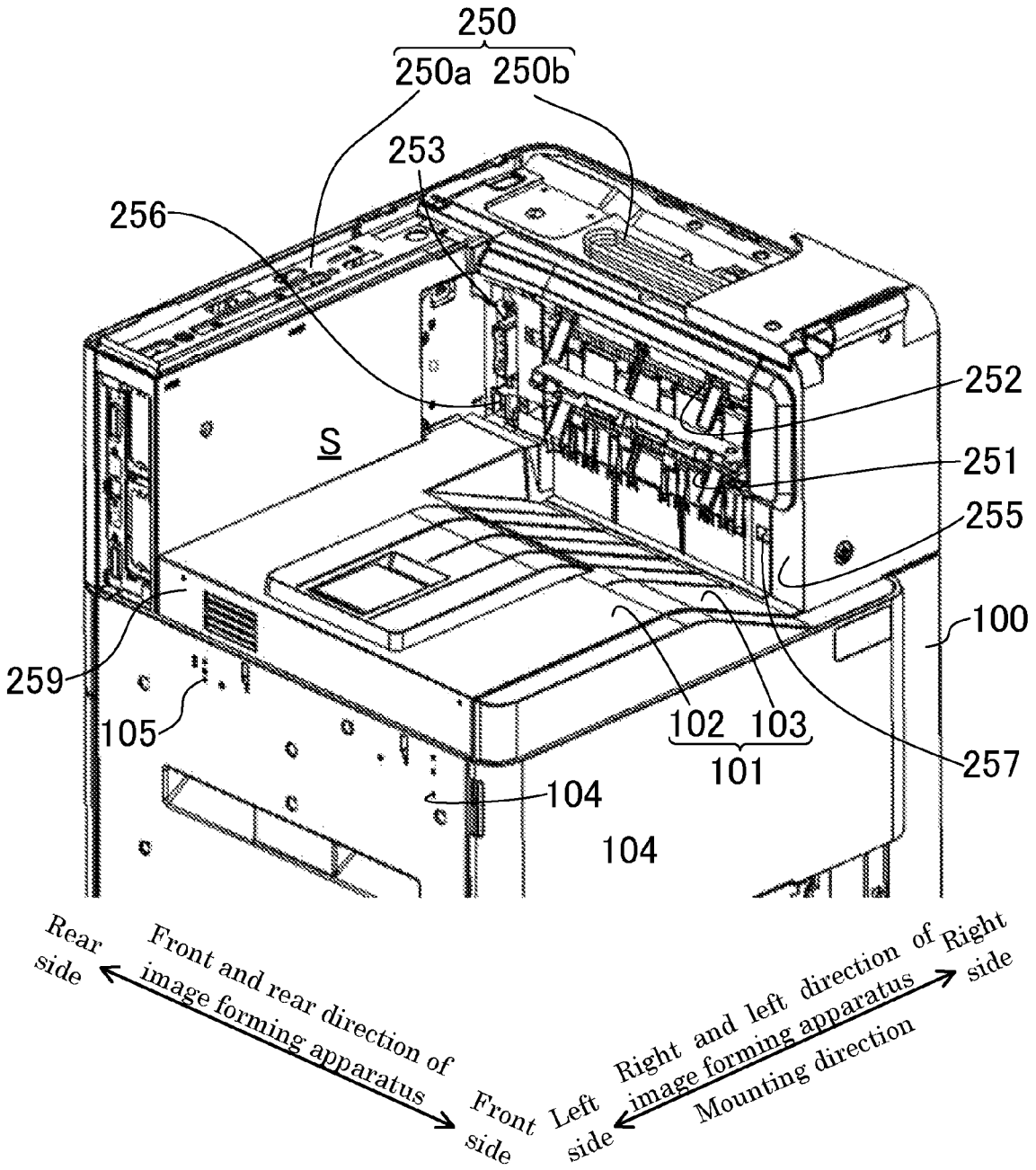
FIG. 4 is a perspective view illustrating an image forming apparatus body before a relay conveyance device is mounted.
Figure 5:
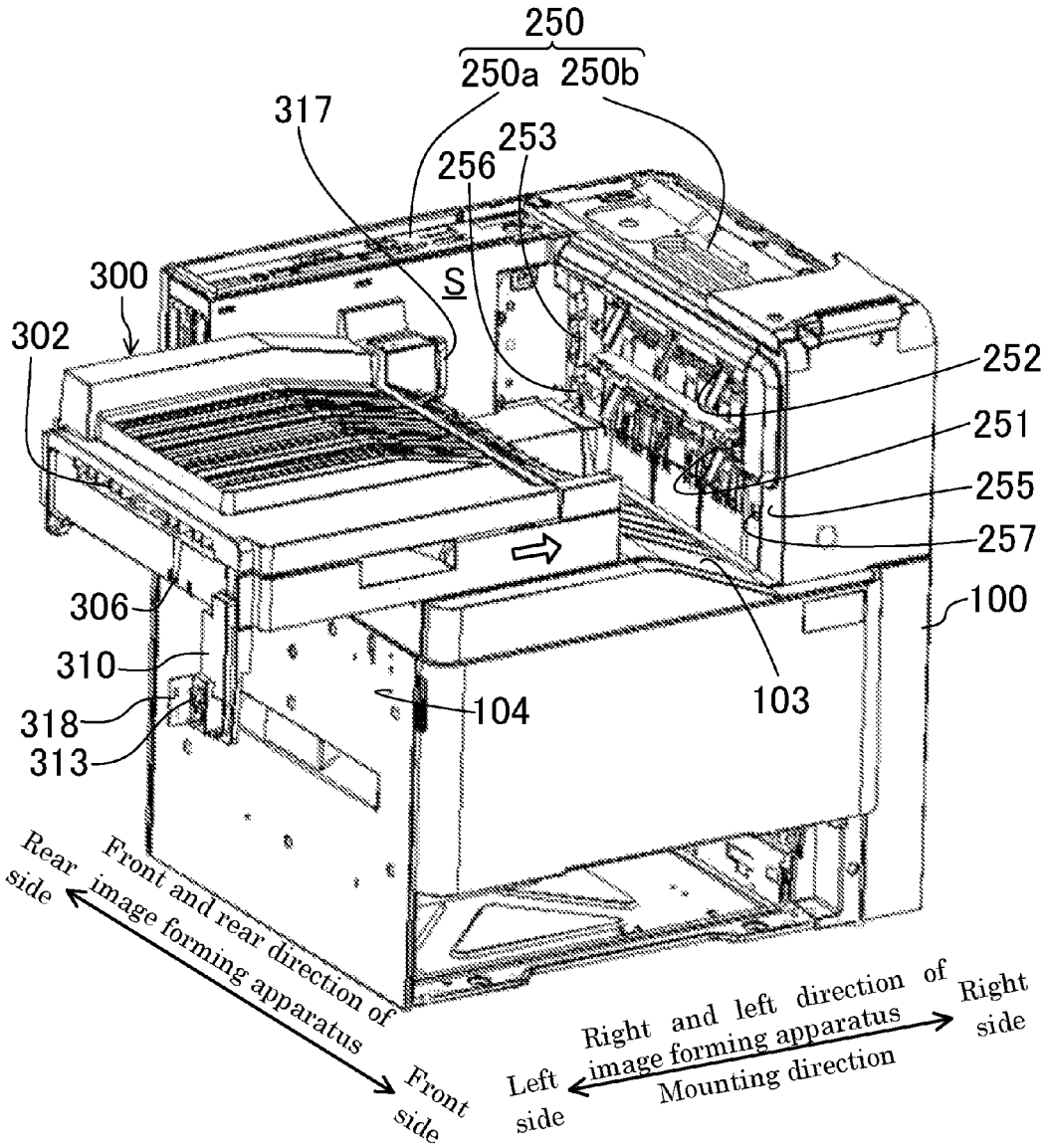
FIG. 5 is a perspective view of an image forming apparatus body while a relay conveyance device is being mounted.

From a rear end portion in the vertical wall part 255 of the right connection casing part 250*b*, a body connector 253 for supplying power to the relay conveyance device 300 is exposed (see FIG. 4 and FIG. 5). The relay conveyance device 300 is a device for conveying a paper P, which was subjected to image formation and discharged to in-body paper discharge space S from the first paper discharge port 251, to the post-processing apparatus 400. The post-processing apparatus 400 is mounted at the left side surface of the image forming apparatus A (the image forming apparatus body 1) in the present embodiment, and performs a post-process such as a staple processing on the paper P subjected to image formation.

An upper surface 200*a* of the scanner casing part 200 is covered by a document cover 202 so as to be openable and closable. The image reading unit 201 accommodated in the scanner casing part 200 optically reads a document placed on the upper surface 200*a* of the scanner casing part 200, and generates image data thereof. The image data generated by the image reading unit 201 is stored in a data storage unit (not illustrated).

The body casing part 100 is formed in an approximately rectangular parallelepiped shape and the image forming unit 20 is arranged near an upper right side of the body casing part 100. The image forming unit 20 is provided at an upper side thereof with the fixing unit 40, and is provided at a left side and a lower side thereof with a paper feeding unit 10. The paper feeding unit 10 has a paper feeding cassette 10*a* in which the paper P is accommodated, and a pick-up roller 10*b* for taking out the paper P in the paper feeding cassette 10*a* and sending the paper P to an exterior of the cassette. The paper P sent to the exterior of the cassette by the paper feeding cassette 10*a* is supplied to the image forming unit 20 via a conveying roller pair 11.

The image forming unit 20 has a photosensitive drum 21, a charging device 23, an exposure device 25, a developing device 27, and a transfer device 29. In the image forming unit 20, a peripheral surface of the photosensitive drum 21 is firstly charged by the charging device 23, laser light based on the document image data (the image data of the document image generated by the image reading unit 201) is nextly irradiated to the surface of the photosensitive drum 21 by the exposure device 25 to generate an electrostatic latent image, the formed electrostatic latent image is developed by the developing device 27 to form a toner image, and then the aforementioned toner image is transferred to the paper P supplied from the paper feeding unit 10 by the transfer device 29, and the paper P subjected to the transfer is supplied to the fixing unit 40. It is noted that a reference numeral 24 of FIG. 2 indicates a cleaning unit that removes remaining toner remained on the surface of the photosensitive drum 21.

The fixing device 40 has a fixing roller 40*a* and a pressing roller 40*b*. The fixing roller 40*a* is heated by its internal heater. In the fixing device 40, the paper P supplied by the image forming unit 20 is pressed and heated between the fixing roller 40*a* and the pressing roller 40*b*, so that the toner image is fixed to the paper P. Then, the paper P with the toner image fixed by the fixing device 40 is conveyed upward by the fixing roller 40*a* and the pressing roller 40*b*. A conveyance path for conveying the paper P is branched into a first conveyance path T1 and a second conveyance path T2 at an upper side of the fixing device 40, and the paper P sent by the fixing roller 40*a* and the pressing roller 40*b* is supplied to the first conveyance path T1 or the second conveyance path T2.

The first conveyance path T1 is curved leftward and upward from the fixing device 40 and is connected to the aforementioned first paper discharge port 251. In the vicinity of the first paper discharge port 251 of the first conveyance path T1, a discharge roller 12 for discharging the paper P is arranged. The second conveyance path T2 extends upward from the fixing device 40, is bent leftward, and is connected to the aforementioned second paper discharge port 252. In the vicinity of the second paper discharge port 252 of the second conveyance path T2, a discharge/inversion roller 13 for discharging or switching back the paper P is arranged. A conveyance path T3 for duplex printing for switching back the paper P and supplying the paper P to the image forming unit 20 again in the case of performing duplex printing on the paper P is further connected to the aforementioned second conveyance path T2.

In the state in which the relay conveyance device 300 has not been mounted in the in-body paper discharge space S (see FIG. 4), the paper P subjected to image formation and discharged to in-body paper discharge space S from the first paper discharge port 251 is received in a paper tray 101 which is a bottom wall part of the in-body paper discharge space S. It is noted that the second paper discharge port 252 is used at the time of switchback conveyance of the paper P and the like. On the other hand, in the state in which the relay conveyance device 300 has been mounted in the in-body paper discharge space S (the state illustrated in FIG. 1 to FIG. 3), the paper P subjected to image formation and discharged from the first paper discharge port 251 is supplied to a relay conveyance path T4 in the relay conveyance device 300.

The relay conveyance device 300 is formed in an approximately rectangular parallelepiped shape as a whole view. The relay conveyance device 300 is formed at a right wall thereof with a paper feeding port 301 communicating with the first paper discharge port 251, and is formed at a left wall thereof with a paper discharge port 302 communicating with a paper feeding port of the post-processing apparatus 400. The relay conveyance path T4 in the relay conveyance device 300 extends nearly horizontally toward the paper discharge port 302 from the paper feeding port 301. The relay conveyance path T4 is formed by four conveying roller pairs 304.

The relay conveyance device 300 is detachably mounted on the paper tray 101 of the in-body paper discharge space S. As illustrated in FIG. 4, the paper tray 101 is formed by the upper surface portion of the body casing part 100. The paper tray 101 has a horizontal surface portion 102 and an inclination surface portion 103. The inclination surface portion 103 is formed rightward and downward at a right end portion of the upper surface portion of the body casing part 100. As described above, the inclination surface portion 103 is provided, so that the paper P discharged from the first paper discharge port 251 can be allowed to slide down along the inclination surface portion 103 and the end edge of the paper P can be aligned.

From a front side surface in a mounting direction of the relay conveyance device 300, an input connector 317 (see FIG. 5 and FIG. 17) connected to an electrical board of the relay conveyance device 300 is exposed. When the relay conveyance device 300 has been mounted on the paper tray 101, this connector is fitted into the body connector 253 (see FIG. 4 and FIG. 5) exposed from the vertical wall part 255 of the right connection casing part 250*b* and electrically connects the relay conveyance device 300 and the image forming apparatus body 1 to each other.

As illustrated in FIG. 6 to FIG. 14, one end side of a fixing member 310 for holding the mounting state of the relay conveyance device 300 to the image forming apparatus body 1 is rotatably supported to a left wall (a rear end surface in a mounting direction) of the relay conveyance device 300 so as to be vertically rotatable such that the fixing member 310 moves along the left wall of the relay conveyance device 300 by a cylindrical shaft 305 having a sectional C shape.

The fixing member 310 is configured by combining a base member 311 of a back side (the right side of the image forming apparatus body 1) with a cover member 312 of a front side (the left side of the image forming apparatus body 1). The base member 311 is formed by a sheet metal member and is formed at one end side thereof with a shaft hole 311*a* into which the cylindrical shaft 305 is inserted. Moreover, the base member 311 is formed with a long hole 311*b* continuously connected to an edge portion of the shaft hole 311*a* via a communicating part 311*d*. Furthermore, the base member 311 is formed at one end and an opposite end thereof with engaging parts 311*c* (see FIG. 11) for fixing the cover member 312. Furthermore, from the one end of the base member 311 in a width direction (a direction perpendicular to a longitudinal direction), a connection plate 318 is upright to the post-processing device 400 side. The connection plate 318 is formed by bending a sheet metal at a right angle. The base member 311 is provided at the other end side thereof with a relay connector 313 that relays the image forming apparatus body 1 and the post-processing device 400, such that the relay connector 313 is exposed from the cover member 312. The cover member 312 is formed at the other end side thereof with an opening 312*a* through which the relay connector 313 is exposed to an exterior. In the fixing member 310, an end portion of an extension side of a harness 316 extending outside the relay conveyance device 300 from the device 300 is accommodated. One end of the harness 316 is connected to the aforementioned input connector 317. The end portion of the extension side of the harness 316 is accommodated in the fixing member 310 via the cylindrical shaft 305 and the shaft hole 311*a* and is connected to the relay connector 313.

The aforementioned fixing member 310 is assembled in the following procedure. Firstly, the relay connector 313 connected to the harness 316 extending from the relay conveyance device 300 is inserted into the long hole 311*b* (see FIG. 12) of the base member 311, and then the harness 316 is inserted into the shaft hole 311*a* from the long hole 311*b* through the communicating part 311*d*. When the shaft hole 311*a* is allowed to be fitted around the cylindrical shaft 305, the base member 311 is held around the cylindrical shaft 305 so as to be rotatable. Next, when the relay connector 313 (see FIG. 13) is fixed at a predetermined position of the other end side of the base member 311 and the cover member 312 is mounted to the base member 311 so that the relay connector 313 is fixed in the state of being exposed to an exterior from the opening 312*a* of cover member 312. Furthermore, an engaging protrusion 312*b* and an engaging piece 312*c* (see FIG. 11) formed at the one end and the other end of the cover member 312 are fitted into the engaging parts 311*c* of the base member 311 through elastic deformation, so that the cover member 312 is fixed to the base member 311.

In the state in which the fixing member 310 has been mounted to the relay conveyance device 300, the harness 316 is accommodated in a space (that is, an interior of the fixing member 310) surrounded by the base member 311 and the cover member 312, so that only the relay connector 313 is exposed to an exterior. Furthermore, the connection plate 318, which is a part of the base member 311, is adjacent to a side surface of the exposed relay connector 313 and protrudes to the post-processing apparatus 400 side along the side surface. The degree of protrusion of the connection plate 318 is larger than the degree of protrusion of the relay connector 313 to the post-processing apparatus 400 side. Since the harness 316 is not exposed to an exterior, it is possible to prevent the harness 316 from being damaged while being interposed between a packing member and another member during the transportation of the relay conveyance device 300 or the mounting work of the relay conveyance device 300 to the image forming apparatus body 1. Furthermore, it is possible to prevent the front end of the relay connector 313 from being broken in contact with a wall surface and the like by the connection plate 318.

Figure 15:
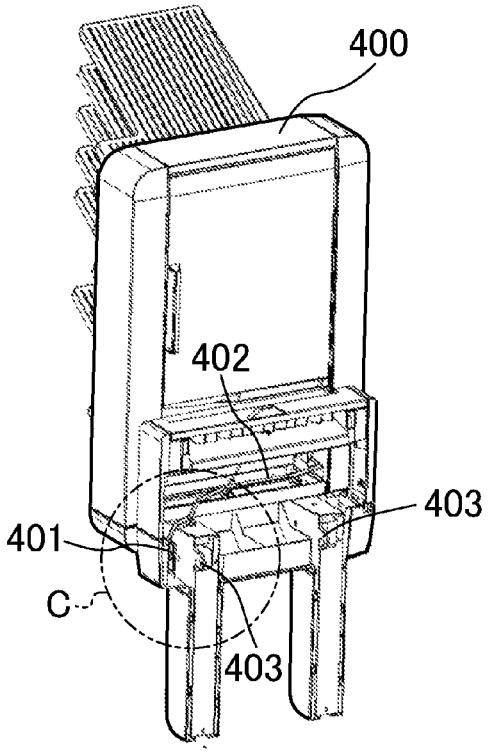
FIG. 15 is a perspective view when a post-processing device is viewed from the back side.
Figure 16:
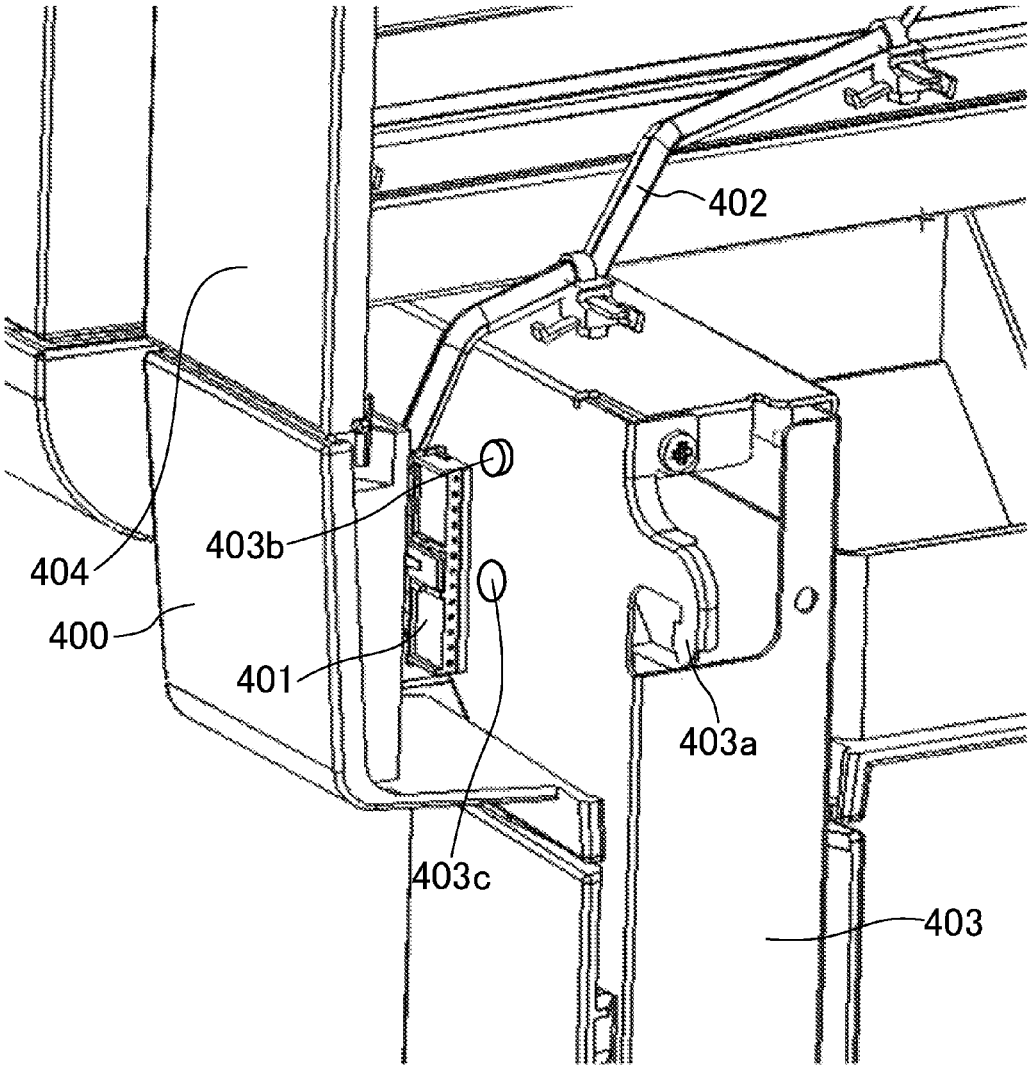
FIG. 16 is an enlarged view of a part C of FIG. 15.

On the other hand, as illustrated in FIG. 15 and FIG. 16, at the back side of the post-processing apparatus 400, a connector 401 is arranged to be connected to an electrical board of the post-processing apparatus 400 via a harness 402. Furthermore, by connecting the connector 401 of the post-processing apparatus 400 side to the relay connector 313, the post-processing apparatus 400 is electrically connected to the image forming apparatus body 1 via the relay connector 313. At this time, a pair of hooks 403*a* (see FIG. 16) formed at the back side of the post-processing apparatus 400 are configured to be hooked to locked parts (not illustrated) of the image forming apparatus body 1 side.

At the lateral side of the cylindrical shaft 305 in the left wall (the rear end surface in the mounting direction) of the relay conveyance device 300, an engaging claw 306 serving as an engaging part protrudes. In the vicinity of the relay connector 313 of the fixing member 310 (the base member 311), an engaging hole 314 serving as an engaged part is formed. Furthermore, by a rotation operation in which the cylindrical shaft 305 of the fixing member 310 is employed as a fulcrum, engagement/disengagement between the engaging claw 306 and the engaging hole 314 is performed. In contrast to this, an engaging claw (an engaging part) may also be provided to the fixing member 310 side and an engaging hole (an engaged part) may also be provided to the relay conveyance device 300 side. Furthermore, a connection part 319 protruding downward is formed at the rear end of the left wall of the relay conveyance device 300. The connection part 319 (see FIG. 6) is formed with an insertion port into which a screw portion of a screw is inserted.

Figure 17:
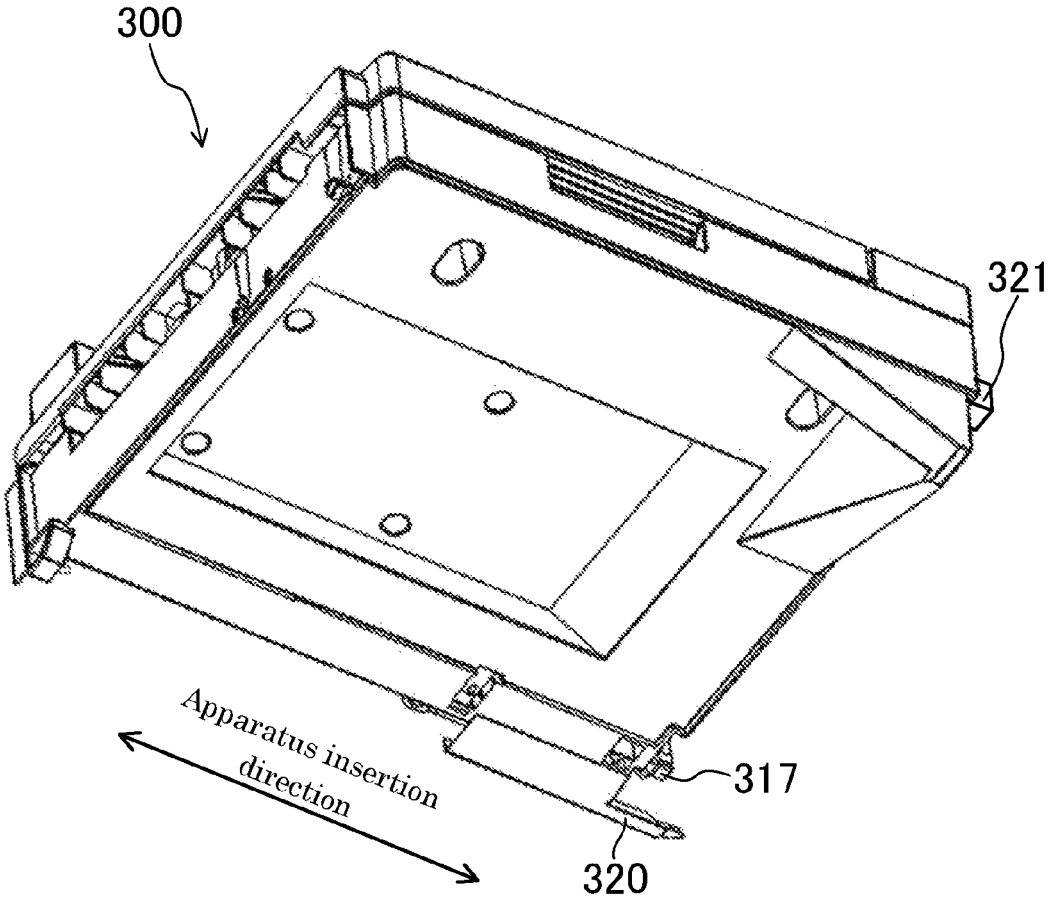
FIG. 17 is a perspective view when a relay conveyance device is viewed from a bottom side in a state in which a fixing member has been detached from a relay conveyance device.

On the other hand, as illustrated in FIG. 17, at the rear end side of the right wall (the front end surface in the mounting direction) of the relay conveyance device 300, an input connector 317 and a positioning guide 320 are provided so as to protrude in the mounting direction. Furthermore, at the front end side of the right wall of the relay conveyance device 300, an engaging protrusion 321 is provided so as to protrude in the mounting direction. The positioning guide 320 is formed by bending a sheet metal in an L shape and its front end portion is bent inward to serve as an inclination surface. The degree of protrusion (the degree of protrusion in the mounting direction of the relay conveyance device 300) of the positioning guide 320 is larger than the degree of protrusion of the input connector 317. The aforementioned engaging protrusion 321 is a protrusion integrally formed with a resin member constituting the relay conveyance device 300 and having a rectangular cylindrical shape, and each ridge of the front end surface is formed in a C plane shape.

Figure 18:
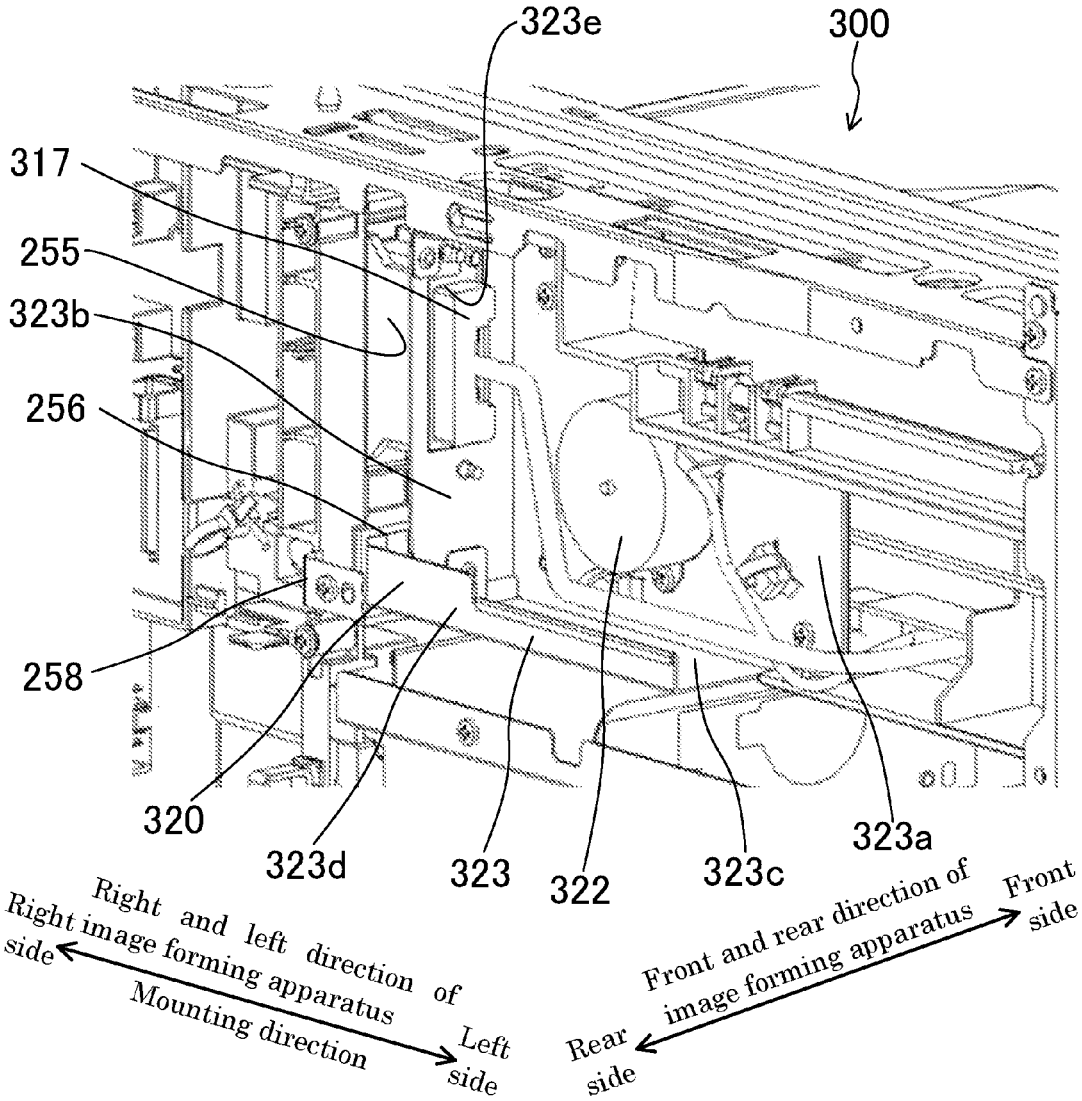
FIG. 18 is a perspective view when viewed from a right obliquely rear side of an image forming apparatus, which illustrates an internal structure of a connection part between a relay conveyance device and an image forming apparatus.

As illustrated in FIG. 18, the aforementioned positioning guide 320 is integrally provided to a support member 323 mounted with a motor 322 for rotationally driving the conveying roller pairs 304 and the input connector 317. The support member 323 is formed by bending a sheet metal member. The support member 323 includes a motor mounting surface 323*a*, a connector mounting surface 323*b*, a bottom surface 323*c*, and a guide surface 323*d*. The motor mounting surface 323*a* is a vertical plane following the mounting direction of the relay conveyance device 300. The connector mounting surface 323*b* includes a vertical surface vertically extending rearward from the front end in the mounting direction of the motor mounting surface 323*a*. The bottom surface 323*c* horizontally extends rearward from a lower end of the motor mounting surface 323*a*. The guide surface 323*d* is upright from an end portion of the bottom surface 323*c* to face the motor mounting surface 323*a*. The positioning guide 320 is formed in a sectional L shape by a part of the bottom surface 323*c* and the guide surface 323*d* and extends along the mounting direction of the relay conveyance device 300. The input connector 317 is inserted into an opening 323*e* formed in the connector mounting surface 323*b* and is fixed. The motor 322 is coupled to the motor mounting surface 323*a* by a screw.

In the vertical wall part 255 of the body casing part 100, a rectangular positioning hole 256 (see FIG. 4 and FIG. 18) is formed at a position corresponding to the positioning guide 320 and a rectangular engaging concave part 257 (see FIG. 4) is formed at a position corresponding to the engaging protrusion 321. Furthermore, as illustrated in FIG. 18, the body casing part 100 is mounted with a grounding member 258. The grounding member 258 is formed by a metallic thin plate having elasticity and its one end is coupled to a metal frame of the body casing part 100. The other end of the grounding member 258 protrudes to the inside of the positioning hole 256. When the relay conveyance device 300 is mounted on the image forming apparatus body 1, the positioning guide 320 is inserted into the positioning hole 256 and abuts the other end of the grounding member 258. In this way, the relay conveyance device 300 is grounded via the body casing part 100.

In the vicinity of the engaging hole 314 of the fixing member 310 (the base member 311), a screw insertion hole 315 (corresponding to a first insertion hole. See FIG. 7, FIG. 9, and FIG. 13) is formed, and in the left side surface of the image forming apparatus body 1 (the body casing part 100), a mounting hole 104 is formed so as to correspond to the screw insertion hole 315 and a mounting hole 105 is formed so as to correspond to the connection part 319 (see FIG. 4 and FIG. 5). Furthermore, the connection plate 318 of the fixing member 310 is formed with a positioning hole 318*a* and a screw insertion hole 318*b* (corresponding to a second insertion hole) (see FIG. 10).

Figure 6:
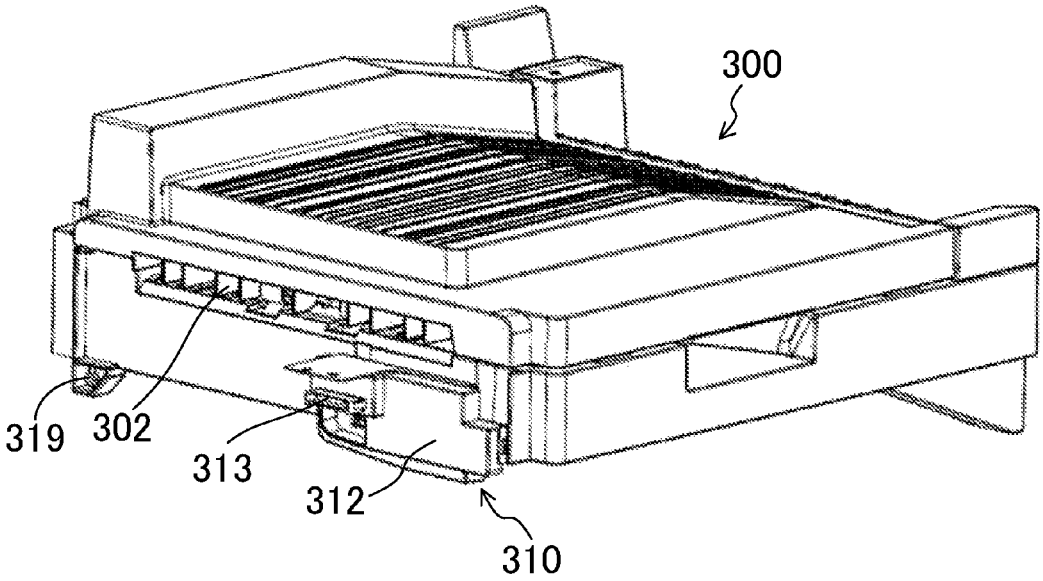
FIG. 6 is a perspective view of a relay conveyance device, which illustrates a fixing member of a storage posture.
Figure 7:
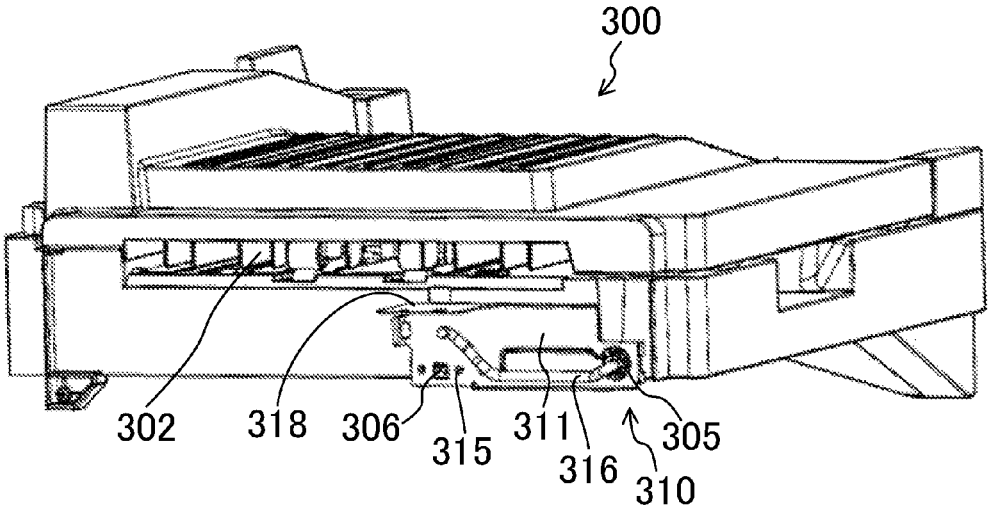
FIG. 7 is a perspective view of a relay conveyance device, which illustrates a fixing member in a state in which a cover member has been detached in a storage posture.
Figure 8:
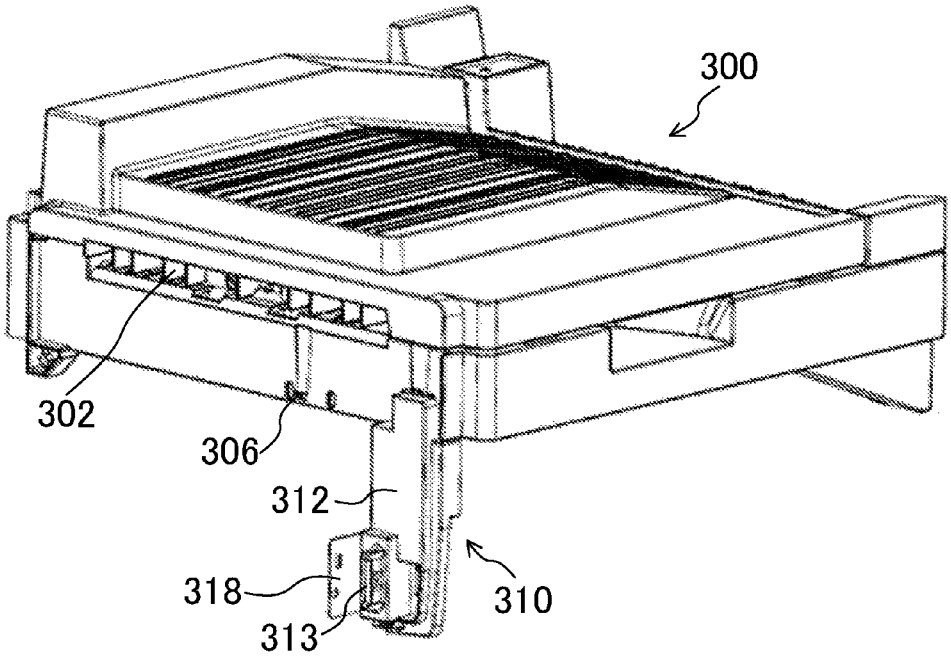
FIG. 8 is a perspective view of a relay conveyance device, which illustrates a fixing member of setup preparation.
Figure 9:
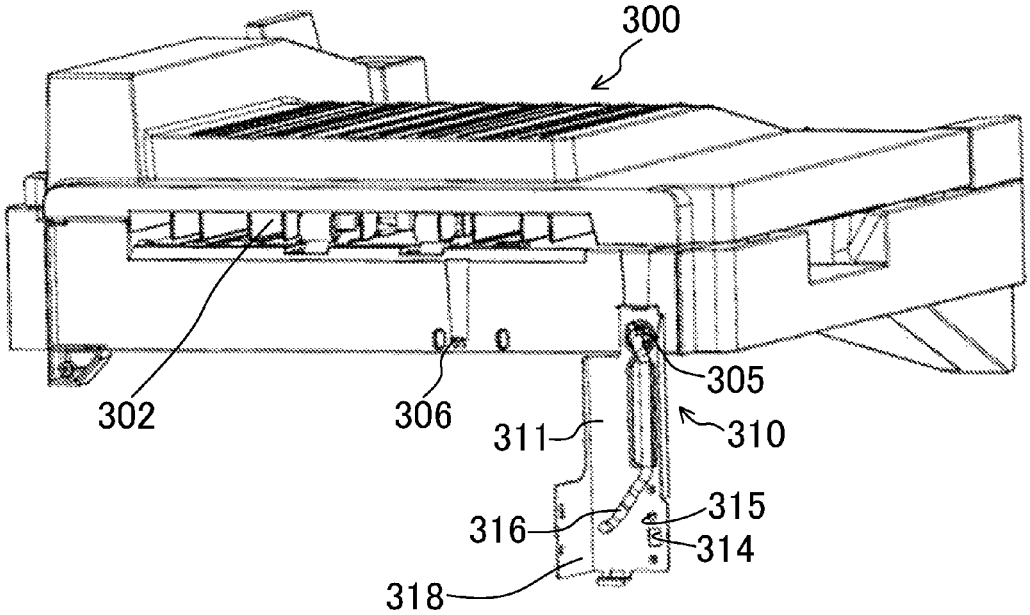
FIG. 9 is a perspective view of a relay conveyance device, which illustrates a fixing member in a state in which a cover member has been detached in setup preparation.
Figure 10:
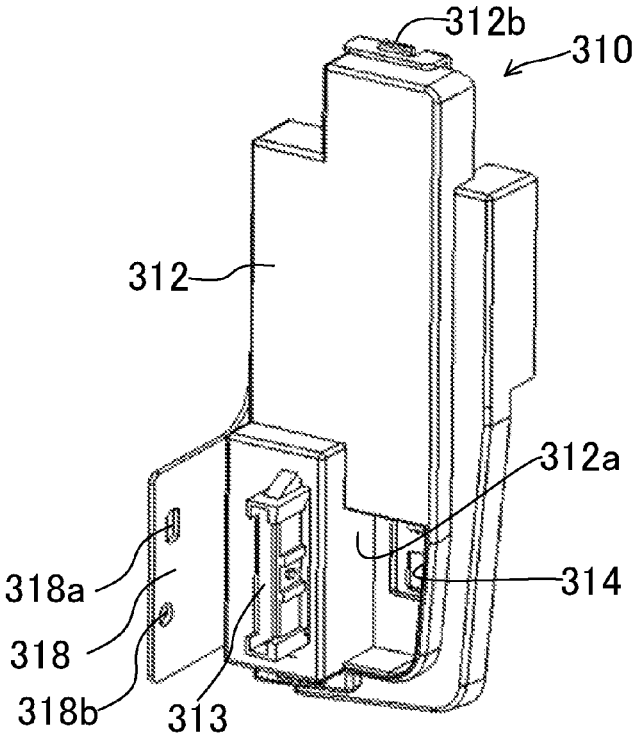
FIG. 10 is a perspective view when a fixing member is viewed from a front side.
Figure 11:
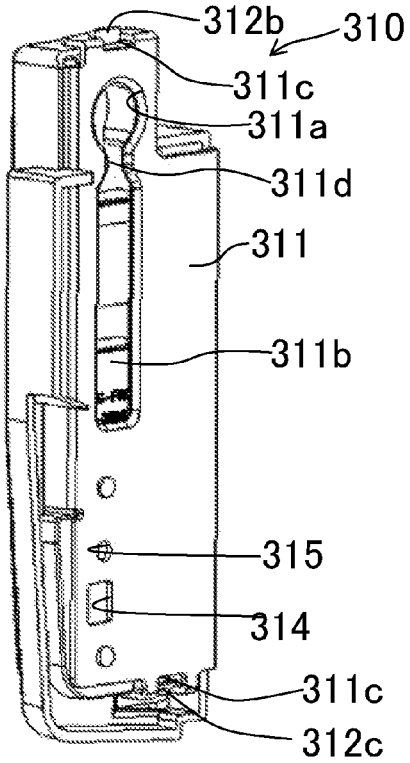
FIG. 11 is a perspective view when a fixing member is viewed from a back side.
Figure 12:
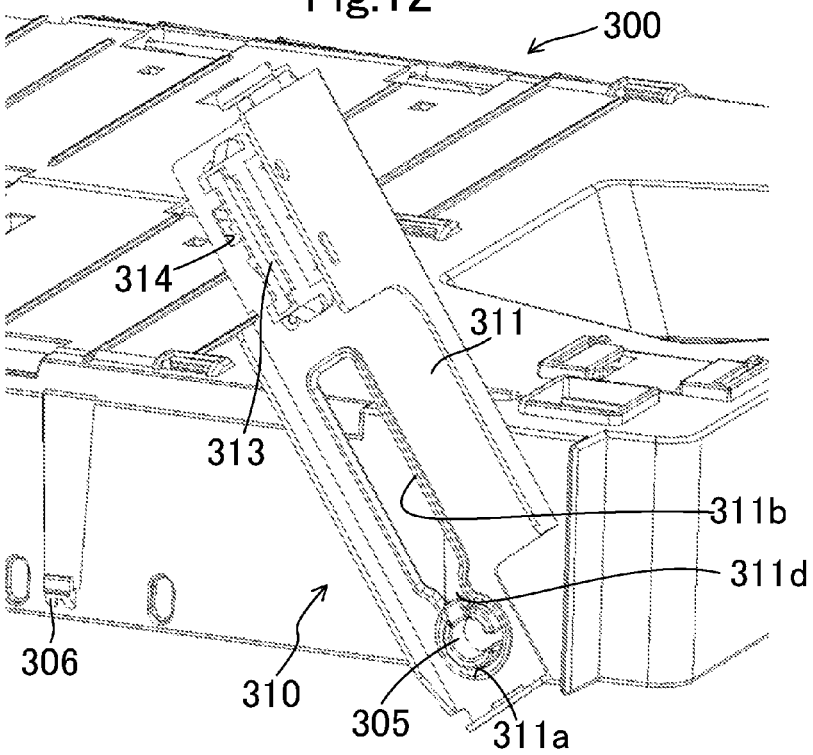
FIG. 12 is a perspective view illustrating a fixing member while a storage posture is being shifted to setup preparation.
Figure 13:
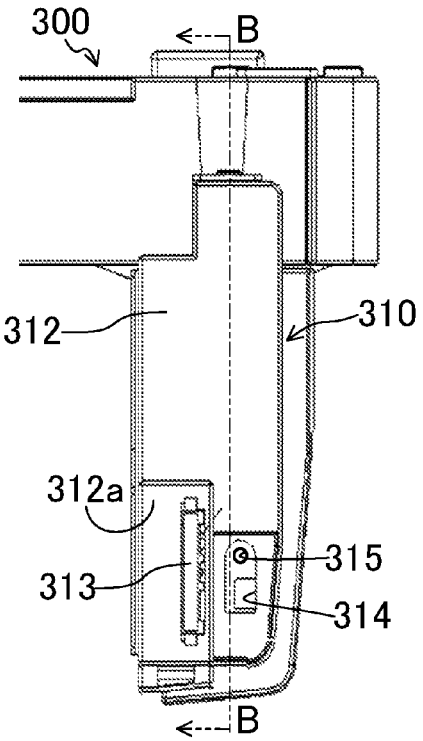
FIG. 13 is a front view illustrating a fixing member of setup preparation.
Figure 14:
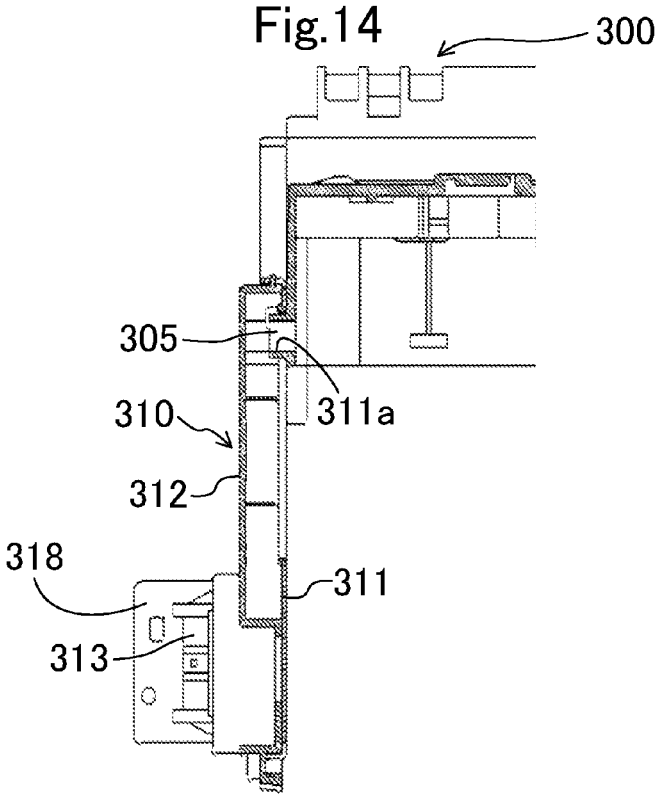
FIG. 14 is a sectional view taken along line B-B of FIG. 13.

Furthermore, at the time of packing, the fixing member 310 is stored in the rear end surface in the mounting direction of the relay conveyance device 300 at a horizontal posture, at which the fixing member 310 has rotated upward, so as not to protrude from the rear end surface (see FIG. 6 and FIG. 7). On the other hand, at the time of mounting (setup) of the relay conveyance device 300 to the image forming apparatus body 1, the relay conveyance device 300 is firstly placed on the paper tray 101 of the image forming apparatus body 1 as illustrated in FIG. 5, and the fixing member 310 is lifted once to separate the engaging claw 306 from the engaging hole 314 as illustrated in FIG. 12. Next, in the state in which the fixing member 310 has been held at a vertical posture at which the fixing member 310 has rotated downward (see FIG. 8, FIG. 9, FIG. 13, and FIG. 14), the fixing member 310 is allowed to protrude from the rear end surface in the mounting direction of the relay conveyance device 300. Then, the relay conveyance device 300 is screwed into an upstream side in a paper discharge direction, and the input connector 317 of the front side surface in the mounting direction of the relay conveyance device 300 is connected to the body connector 253 of the image forming apparatus body 1 (see FIG. 4 and FIG. 5), so that the relay conveyance device 300 is electrically connected to the image forming apparatus body 1. At this time, the positioning guide 320 engages with the positioning hole 256, so that the position in the horizontal direction is restricted. In this way, the input connector 317 is positioned with respect to the body connector 253, so that it is possible to easily connect the input connector 317 and the body connector 253 to each other. Furthermore, the positioning guide 320 engages with the positioning hole 256 and the engaging protrusion 321 engages with the engaging concave part 257, so that the position of the front end side in the mounting direction of the relay conveyance device 300 is restricted with respect to the body casing part 100 in the vertical direction and the front and rear direction.

From this state, a screw (not illustrated) is pushed into the mounting hole 104 of the image forming apparatus body 1 (the body casing part 100) from the screw insertion hole 315 of the fixing member 310 (the base member 311), so that the fixing member 310 is coupled to the image forming apparatus body 1. Moreover, a screw is screwed into the mounting hole 105 (illustrated only in FIG. 4), so that the connection part 319 is fixed to the image forming apparatus body 1. In this way, the position of the rear end side in the mounting direction of the relay conveyance device 300 is restricted with respect to the body casing part 100 in the vertical direction, the front and rear direction, and the right and left direction. Accordingly, the mounting (the setup) of the relay conveyance device 300 to the image forming apparatus body 1 is completed (see FIG. 3).

Then, the hooks 403*a* (see FIG. 16) of a pair of support parts 403 of the post-processing apparatus 400 are hooked to the locked parts (not illustrated) of the image forming apparatus body 1 side, so that the post-processing apparatus 400 is mounted to the side surface of the image forming apparatus body 1. A front cover 404 of a right end portion of the post-processing apparatus 400 is detachable by a fitting configuration using elastic deformation. The front cover 404 is detached and a connector 401 of the post-processing apparatus 400 and the relay connector 313 of the relay conveyance device 300 are connected to each other, so that the post-processing apparatus 400 is electrically connected to the image forming apparatus body 1 via the relay connector 313.

Furthermore, in the front surface of the support part 403 positioned at the front side, a positioning protrusion 403*b* and a mounting hole 403*c* are vertically formed while being spaced apart from each other. The positioning hole 318*a* of the connection plate 318 of the fixing member 310 is fitted around the positioning protrusion 403*b*. Then, a screw is screwed into the mounting hole 403*c* from the screw insertion hole 318*b* formed in the connection plate 318, so that the fixing member 310 and the support part 403 are connected to each other. In this way, the post-processing apparatus 400 is fixed to the image forming apparatus body 1 via the fixing member 310.

As described above, in the present embodiment, the relay connector 313 is provided to the fixing member 310 that holds the setup state of the relay conveyance device 300 and the post-processing apparatus 400 is electrically connected to the image forming apparatus body 1 via the relay conveyance device 300, so that it is not necessary to separately perform a harness process and thus it is possible to shorten the setup time of the relay conveyance device by a portion of the time for the harness process.

Furthermore, the fixing member 310 is provided so as to be rotatable in the vertical direction and is stored in the rear end surface in the mounting direction of the relay conveyance device 300 at a horizontal posture so as not to protrude from the rear end surface at the time of packing, so that it is possible to pack the fixing member 310 in a small space.

Moreover, the engaging claw 306 of the relay conveyance device 300 is allowed to be engaged with and separated from the engaging hole 314 of the fixing member 310, so that it is possible to stably store the fixing member 310 at the time of packing and to quickly set up the relay conveyance device 300.

It is noted that in the aforementioned embodiment, the example in which the image forming apparatus A is a copy machine has been described; however, the technology of the present disclosure is not limited thereto and the image forming apparatus A, for example, may also be a printer, a facsimile, a multifunctional peripheral and the like.

As described above, the technology of the present disclosure is useful for an image forming apparatus including a relay conveyance device that conveys papers, which have been subjected to image formation and discharged from a paper discharge unit of an image forming apparatus body, to a post-processing device provided to the image forming apparatus body.

What is claimed is:

1. An image forming apparatus comprising:

an image forming apparatus body; and a relay conveyance device that is detachably mounted on the image forming apparatus body and conveys a paper, which was subjected to image formation and discharged to a paper discharge unit of the image forming apparatus body, to a post-processing device provided to the image forming apparatus body, wherein the relay conveyance device is provided with a fixing member that holds a mounting state of the relay conveyance device to the image forming apparatus body, the fixing member is provided with a relay connector that relays between the image forming apparatus body and the post-processing device, the post-processing device is electrically connected to the image forming apparatus body via the relay connector, and the fixing member is rotatably supported to a rear end surface in a mounting direction of the relay conveyance device so as to be vertically rotatable such that the fixing member moves along the rear end surface, is stored in the rear end surface in the mounting direction of the relay conveyance device at a horizontal posture, at which the fixing member has been rotated upward, so as not to protrude from the rear end surface at a time of packing, protrudes from the rear end surface in the mounting direction of the relay conveyance device at a vertical posture, at which the fixing member has been rotated downward, and is coupled to the image forming apparatus body at a time of mounting of the relay conveyance device to the image forming apparatus body.

2. The image forming apparatus of claim 1, wherein an engaging part is provided to one of the fixing member and the rear end surface in the mounting direction of the relay conveyance device and an engaged part is provided to another of the fixing member and the rear end surface in the mounting direction of the relay conveyance device, and engagement/disengagement between the engaging part and the engaged part is performed by a rotation operation of the fixing member.

3. An image forming apparatus comprising:

an image forming apparatus body; and a relay conveyance device that is detachably mounted on the image forming apparatus body and conveys a paper, which was subjected to image formation and discharged to a paper discharge unit of the image forming apparatus body, to a post-processing device provided to the image forming apparatus body, wherein the relay conveyance device is provided with a fixing member that holds a mounting state of the relay conveyance device to the image forming apparatus body, the fixing member is provided with a relay connector that relays between the image forming apparatus body and the post-processing device, the post-processing device is electrically connected to the image forming apparatus body via the relay connector, a cylindrical shaft is formed in the relay conveyance device, the relay connector is connected to a harness extending from the cylindrical shaft, the fixing member is configured with a base member and a cover member, the base member has a shaft hole into which the cylindrical shaft is inserted, the cover member has an opening for exposing the relay connector to an exterior, and the harness is accommodated in a space surrounded by the base member and the cover member and the relay connector is exposed from the opening of the cover member.

4. The image forming apparatus of claim 3, wherein a surface formed with the shaft hole of the base member is formed with a first insertion hole into which a coupling member to be connected to the image forming apparatus body is to be inserted and a connection plate upright toward the post-processing device, and the connection plate is formed with a second insertion hole into which a coupling member to be connected to the post-processing device is to be inserted.

5. The image forming apparatus of claim 4, wherein, in the fixing member, the connection plate is adjacent to the relay connector and protrudes in a protruding direction of the relay connector, and a degree of protrusion of the connection plate is larger than a degree of protrusion of the relay connector.

* * * * *